US006047422A

United States Patent [19]

Yousif

[11] Patent Number: 6,047,422

[45] Date of Patent: Apr. 11, 2000

[54] BED EXTENSION DEVICE

[76] Inventor: Gorgius Yousif, 5843 N. Rockwell, Chicago, Ill. 60659

[21] Appl. No.: 09/089,171

[22] Filed: Jun. 2, 1998

[51] Int. Cl.[7] ..... A47C 19/04

[52] U.S. Cl. ..... 5/661; 5/184; 5/507.1

[58] Field of Search ..... 5/661, 504.1, 506.1, 5/507.1, 181, 184

[56] References Cited

U.S. PATENT DOCUMENTS

| | | | |
|---|---|---|---|
| 884,204 | 4/1908 | Piper | 5/507.1 X |
| 2,607,932 | 8/1952 | Doyle | 5/184 |
| 2,941,215 | 6/1960 | Johnson | 5/507.1 |
| 3,064,278 | 11/1962 | Broyles | 5/184 |
| 3,327,328 | 6/1967 | Slivoski | 5/661 |
| 3,688,321 | 9/1972 | Moss et al. | 5/661 |
| 4,937,905 | 7/1990 | Thaxton, Jr. | 5/661 |

FOREIGN PATENT DOCUMENTS

| | | | |
|---|---|---|---|
| 266284 | 7/1929 | Italy | 5/507.1 |

*Primary Examiner*—Michael F. Trettel
*Assistant Examiner*—Robert G. Santos
*Attorney, Agent, or Firm*—Goldstein & Canino

[57] ABSTRACT

A bed extension device for longitudinally or transversely enlarging the sleeping area of a bedding unit which has a mattress and bed frame. The bed extension device comprises an extension frame member which has a forked extension arm extending downward from one end and a frame leg extending downward from the opposite end. The forked extension arm engages a frame lip of the bed frame of the bedding unit, while the frame leg rests upon a floor surface, causing the extension frame member to be positioned parallel to the mattress of the bedding unit. By placing an extension mattress upon the extension frame member, the sleeping area is thus accordingly increased.

2 Claims, 3 Drawing Sheets

BED EXTENSION DEVICE

FIELD OF THE INVENTION

The invention relates to a bed extension device. More particularly, the invention relates to an adaptable device which allows a bed to be extended both longitudinally and transversely so as to provide more sleeping area and comfort.

BACKGROUND OF THE INVENTION

Beds and bedding devices are found in essentially every household. Typically, however, most households purchase bedding units which are smaller and less comfortable than preferred due to economic and space constraints. For instance, twin and queen sized bedding units are found in most bedrooms because of the relative inexpensive nature of these configurations. These units are also commonly purchased because they are easier to transport and fit into most households without consuming a burdensome amount of space.

While twin and queen sized bedding units are found in most households, larger units such as king sized beds are almost universally preferred thereto due to the increased surface area and thus comfort provided thereby. However, since these units are difficult to transport and difficult to situate comfortably in most bedrooms of average size, their comfort is usually forgone in lieu of more convenient twin and queen size units. A device is needed which enables a particular configuration of bedding unit to be enlarged and converted into an alternate sized unit with ease. Various bed and mattress extension devices are found in the art which attempt to accomplish this goal, but most are complex in construction and difficult to use. While these prior art units may be suitable for the particular purpose employed, or for general use, they would not be as suitable for the purposes of the present invention as disclosed hereafter.

SUMMARY OF THE INVENTION

The present invention relates to an adaptable device which allows a bed to be extended both longitudinally and transversely so as to provide more sleeping area and comfort.

In accordance with the invention, there is provided a bed extension device which allows a standard configuration bedding component to be enlarged both longitudinally and transversely as desired, thus allowing the bedding unit to be converted from one standard configuration size to another with minimal expense and great ease.

Further in accordance with the invention, there is provided a bed extension device which allows bedding units to be converted into larger, more comfortable bedding units during sleeping periods and then re-configured to smaller less space-consuming sizes during non-sleeping periods when room floor space is in greater need.

Further in accordance with the invention, there is provided a bed extension device which is simple yet sturdy in construction and may be assembled in an inexpensive and compact manner, thus decreasing shipping and storage costs for said device.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
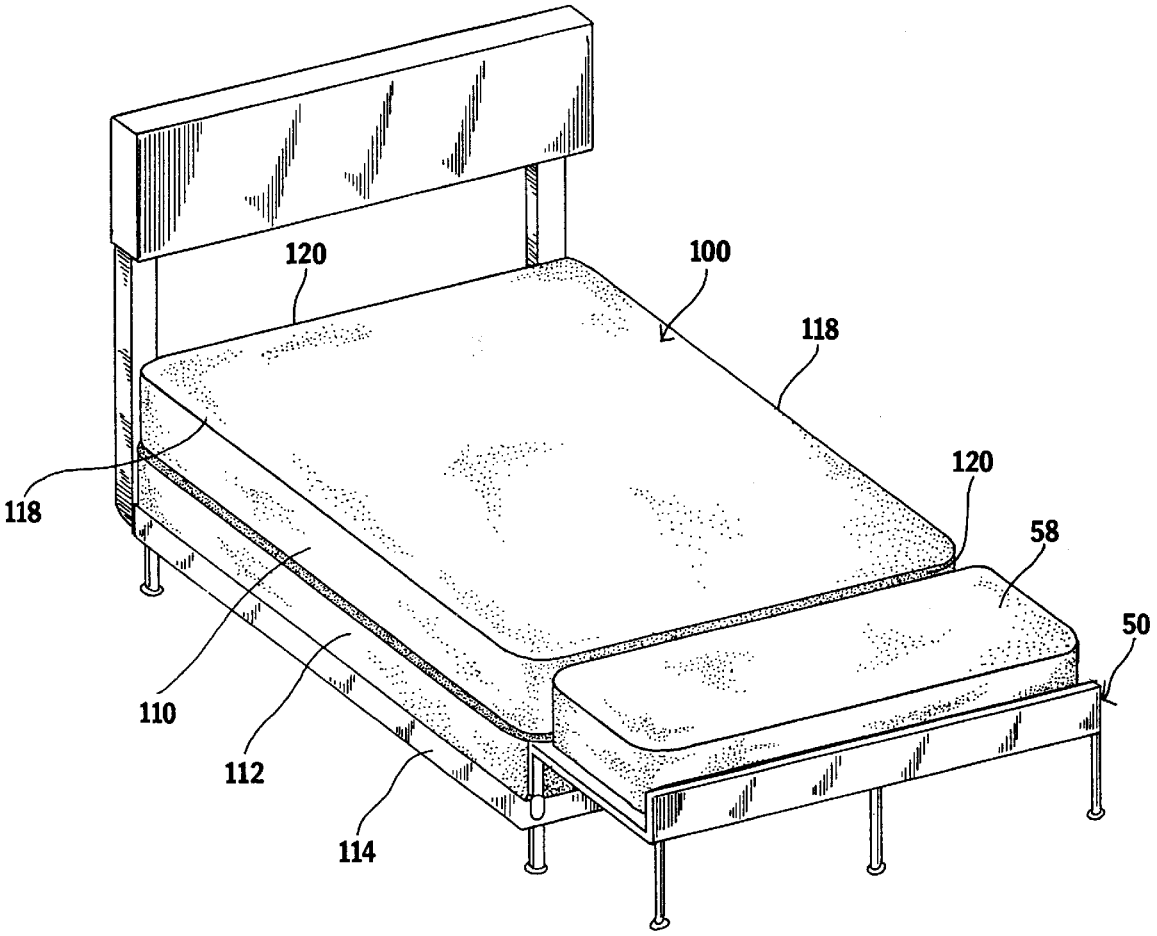
FIG. 1 is a diagrammatic perspective view of a bedding unit which has been longitudinally enlarged by the bed extension device of the instant device.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the bed extension device. The words "proximal end" and "distal end" refer, respectively, to ends of an object nearer to and further from the operator of the object when the object is used in a normal fashion or as is described in the specification.

FIG. 1 illustrates a typical bedding unit 100. The bedding unit 100 comprises a mattress 110, an optional box-spring 112 and a bed frame 114. The bed frame 114 normally possesses a frame lip 116 (as seen in more detail in the cross sectional view of FIG. 3) which surrounds the entire outer periphery of said bed frame 114 and retains the mattress 110 and/or box-spring 112 therein, thus preventing said mattress 110 and/or box-spring 114 from sliding or shifting out of place.

The bedding unit 100 typically comprises four sides—a pair of opposite longitudinal sides 118 and a pair of opposite transverse sides 120. It should be understood, however, that the four sides of the bedding unit 100 may be equal in length. For exemplary purposes of this discussion, however, the bedding unit 100 will be assumed to comprise to opposite parallel longitudinal sides 118 and two opposite parallel transverse sides 120.

Figure 2:
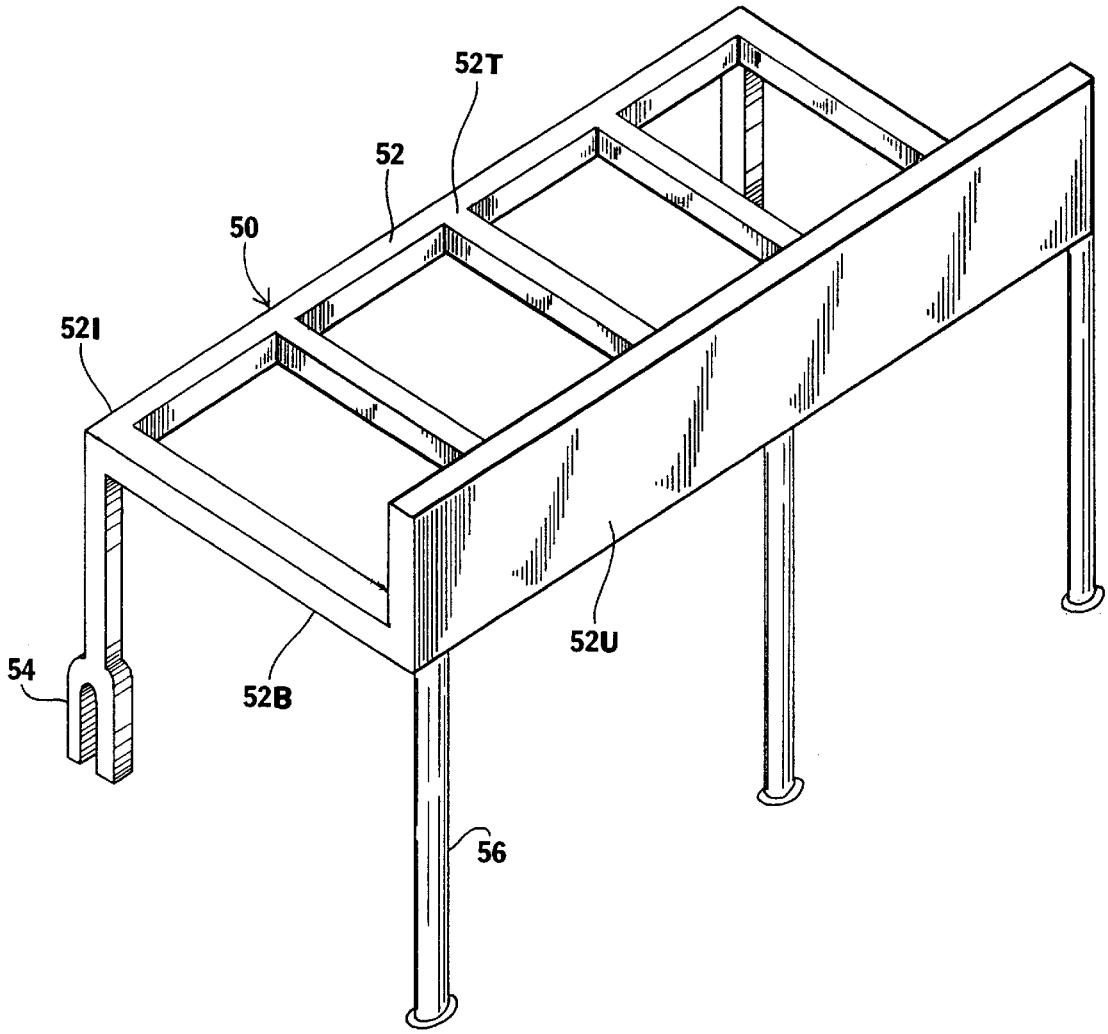
FIG. 2 is an enlarged diagrammatic perspective view of the bed extension device of the instant invention.
Figure 3:
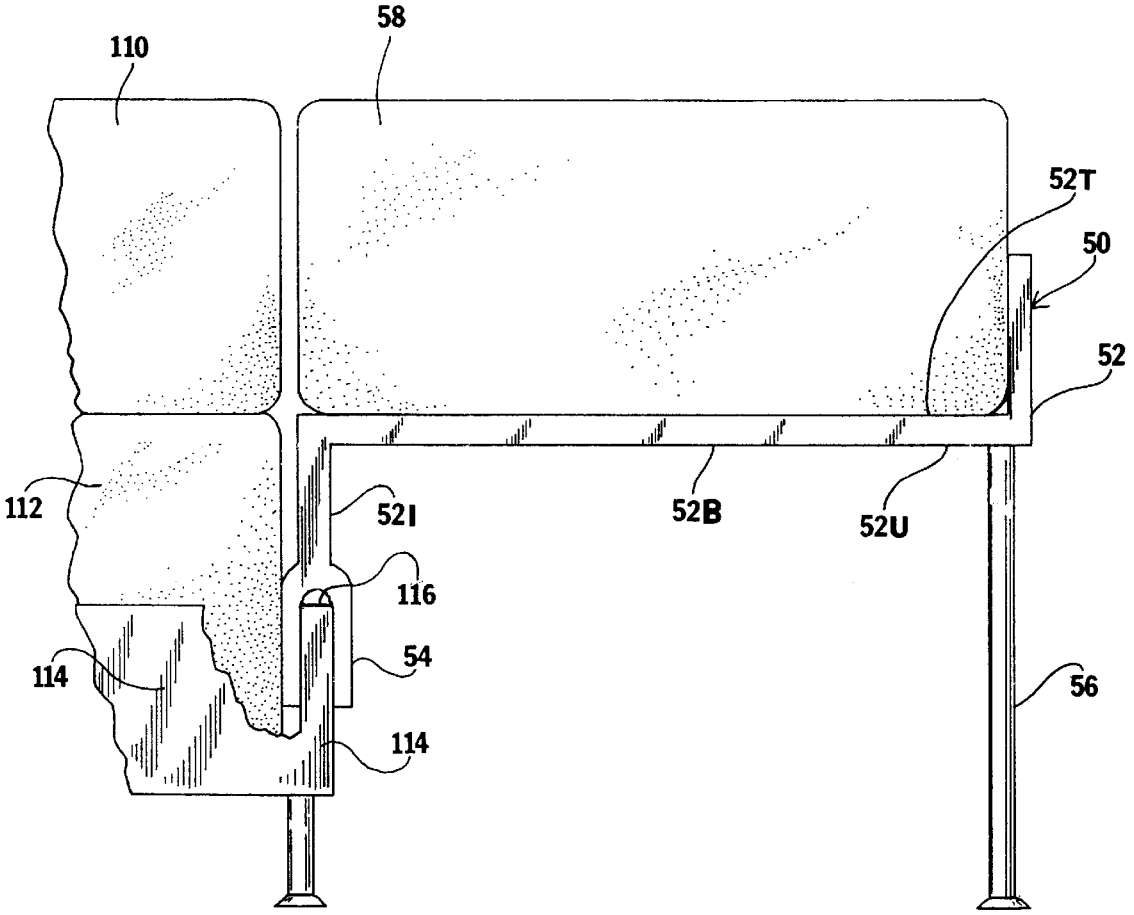
FIG. 3 is a cross sectional view of the bed extension device secured to a bed frame of a bedding unit.

When it is desired to increase the length or width of a bedding unit 100 and thus convert said bedding unit 100 into a larger configuration (such as converting a queen size configuration into a king size) a bed extension device 50 of the instant invention is employed. As seen by referring to FIG. 2 and FIG. 3, the bed extension device 50 comprises an extension frame member 52 having a top 52T and a bottom 52B. The extension frame member 52 further has an inner end 52I and an opposite outer end 52U. A forked extension arm 54 extends downward from the bottom 52B of the inner end 52I of the extension frame member 52. Said forked extension arm 54 is caused to engage the frame lip 116 of the bed frame 114 as seen in FIG. 3. A frame leg 56 extends downward from the bottom 52B of the outer end 52U of the extension frame member 52, said frame leg 56 pivotally secured thereto in the preferred embodiment of the instant invention. Accordingly the extension frame member 52 is supported above the bed frame 114 parallel to the mattress 110 and/or box spring 112.

The supported extension frame member 52 can be secured to any of the sides of the bedding unit 100 to increase the length or width thereof. Once the extension frame member 52 is properly secured to the bed frame 114, an extension mattress 58 is placed upon the top 52T thereof, thus increasing the effective mattress area of the bedding unit 100. It should be understood that the forked extension arm 54 and collapsible frame leg 56 are optimally sized in length so that when the extension frame member 52 is secured to the bed frame 114 and the extension mattress 58 is placed upon the top 52T of said extension frame member 52, the extension mattress 58 is comfortably aligned with the mattress 110 of the bedding unit 100.

What is claimed is:

1. A bed extension device for increasing the sleeping area of a bedding unit, said bedding unit having four sides and comprising a bed frame having a bed frame lip which surrounds an outer periphery of the bed frame, and a mattress resting upon said bed frame and prevented from shifting thereupon by the bed frame lip, the bed extension device comprising:

a) an extension frame member having a top, a bottom, an inner end and an outer end;

b) a forked extension arm extending downward from a bottom of the inner end of the extension frame member;

c) frame legs extending downward from a bottom of the outer end of the extension frame member;

d) an extension mattress which is placed upon the top of the extension frame member, whereby the forked extension arm is caused to engage the frame lip of the bed frame at one of the sides of the bedding unit and the frame legs which extend downward from the bottom of the outer end of the extension frame member rest upon a floor surface located therebeneath, such that the extension frame member and extension mattress which rests thereupon is supported above the bed frame parallel to the mattress of the bedding unit.

2. The bed extension device of claim 1, wherein the frame legs which extend downward from the bottom of the outer end of the extension frame member are pivotally secured to said extension frame member so that they may collapse for easy storage.

* * * * *